US008819874B2

(12) United States Patent
Hand

(10) Patent No.: US 8,819,874 B2
(45) **Date of Patent: *Sep. 2, 2014**

(54) FLUSH VALVE STRUCTURE FOR A TOILET TANK

(76) Inventor: Douglas P. Hand, Lake Oswego, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/464,877

(22) Filed: May 4, 2012

(65) Prior Publication Data

US 2013/0283513 A1 Oct. 31, 2013

Related U.S. Application Data

(63) Continuation-in-part of application No. 13/455,865, filed on Apr. 25, 2012.

(51) Int. Cl.
*E03D 1/14* (2006.01)
*E03D 1/34* (2006.01)
*E03D 1/35* (2006.01)

(52) U.S. Cl.
USPC ..... 4/325; 4/391; 4/393; 4/394; 4/399; 4/403

(58) Field of Classification Search
CPC ..... E03D 1/34; E03D 1/35; E03E 1/14
USPC ..... 4/394–395, 324–327, 378–379, 383, 4/387, 391, 399, 389, 415
See application file for complete search history.

(56) References Cited

U.S. PATENT DOCUMENTS

| | | | | |
|---|---|---|---|---|
| 413,590 | A | 10/1889 | White | |
| 1,069,658 | A | 8/1913 | Drew | |
| 1,450,133 | A | 3/1923 | Cahill | |
| 3,172,129 | A | 3/1965 | Fulton et al. | |
| 4,604,763 | A | 8/1986 | Sprang | |
| 4,898,124 | A * | 2/1990 | Granberg et al. | 122/382 |
| 5,040,247 | A * | 8/1991 | Stevens | 4/324 |
| 6,658,673 | B2 * | 12/2003 | Hand | 4/326 |
| 7,865,979 | B2 * | 1/2011 | Hand | 4/325 |
| 2006/0053542 | A1 * | 3/2006 | Hand | 4/325 |
| 2008/0201833 | A1 * | 8/2008 | Scruggs | 4/393 |

* cited by examiner

*Primary Examiner* — Huyen Le
*Assistant Examiner* — Christine Skubinna
(74) *Attorney, Agent, or Firm* — Mohr Intellectual Property Law Solutions, PC

(57) ABSTRACT

A toilet tank flush valve structure includes a valve base. A float assembly that is adjustable in buoyancy is movable between a sealing position and a flushing position. An overflow tube is attached to the float assembly and extends from a lower end in communication with a water outflow passage of the valve base to an upper end in communication with the interior space of the toilet tank. The upper end of the overflow tube is adjustable relative to the float assembly independently of the buoyancy of the float assembly. A guide member guides movement of the float assembly. A stop member on the guide member limits upward travel of the float assembly from its sealing position. The stop member is adjustable in position lengthwise of the guide member or by extension of the guide member independently of the buoyancy of the float assembly.

37 Claims, 4 Drawing Sheets

FLUSH VALVE STRUCTURE FOR A TOILET TANK

CROSS-REFERENCE TO RELATED APPLICATION

This application is a continuation-in-part of U.S. patent application Ser. No. 13/455,865 filed Apr. 25, 2012.

BACKGROUND OF THE INVENTION

The subject matter disclosed herein relates to a flush valve structure for a toilet tank, and to the subject matter of U.S. Pat. No. 7,865,979, of which the disclosure is hereby incorporated herein by reference.

SUMMARY OF THE INVENTION

In accordance with a first aspect of the disclosed subject matter there is provided a toilet tank flush valve structure, for use with a toilet tank that is provided with a water supply valve and has an interior space bounded by a floor formed with an outlet hole, the flush valve structure comprising a valve base for installation in the outlet hole formed in the floor of the toilet tank, the valve base defining a water outflow passage having an upper end and a lower end and including a first valve member at the upper end of the water outflow passage, a float assembly that is movable relative to the valve base between a sealing position in which a second valve member at a lower end of the float assembly engages the first valve member in sealing relationship and a flushing position in which the second valve member is spaced upwardly from the first valve member, the float assembly defining a float chamber that is adjustable in volume and also defining a passage extending upwardly therethrough, and an overflow tube extending upward through the passage defined by the float assembly, wherein the overflow tube is adjustably attached to the float assembly and extends upward from a lower end in fluid communication with the water outflow passage of the valve base to an upper end in fluid communication with the interior space of the toilet tank, and a guide member that extends upward from the valve base through the overflow tube for guiding movement of the float assembly relative to the valve base, the guide member defining a passageway extending longitudinally of the guide member from an inlet at an upper end region of the guide member, for connection to the water supply valve, to an outlet at a lower end region of the guide member in fluid communication with the water outflow passage of the valve base, and wherein the guide member is provided with a stop member at a location above the float assembly for limiting upward travel of the float assembly from its sealing position, and the stop member is adjustably positioned through extension of the guide member whereby said upward travel is selectively adjustable.

In accordance with a second aspect of the disclosed subject matter there is provided a toilet tank flush valve structure, for use with a toilet tank that is provided with a water supply valve and has an interior space bounded by a floor formed with an outlet hole, the flush valve structure comprising a valve base for installation in the outlet hole formed in the floor of the toilet tank, the valve base defining a water outflow passage having an upper end and a lower end and including a first valve member at the upper end of the water outflow passage, a float assembly that is movable relative to the valve base between a sealing position in which a second valve member at a lower end of the float assembly engages the first valve member in sealing relationship and a flushing position in which the second valve member is spaced upwardly from the first valve member, the float assembly being adjustable in buoyancy, and an overflow tube that is attached to the float assembly and extends upward from a lower end in fluid communication with the water outflow passage of the valve base to an upper end in fluid communication with the interior space of the toilet tank, the upper end of the overflow tube being adjustable relative to the float assembly independently of buoyancy of the float assembly, a guide member that extends upward from the valve base for guiding movement of the float assembly relative to the valve base, the guide member defining a passageway extending longitudinally of the guide member from an inlet at an upper end region of the guide member, for connection to the water supply valve, to an outlet at a lower end region of the guide member in fluid communication with the water outflow passage of the valve base, and a stop member mounted on the guide member at a location above the float assembly for limiting upward travel of the float assembly from its sealing position, the stop member being adjustable in position through extension of the guide member independently of the buoyancy of the float assembly and independently of the upper end of the overflow tube.

In accordance with a third aspect of the disclosed subject matter there is provided a toilet tank installation comprising a toilet tank having an interior space bounded by a floor formed with an outlet hole, a water supply valve positioned inside the tank and connected to a water source, and a flush valve structure comprising a valve base installed in the outlet hole formed in the floor of the toilet tank, the valve base defining a water outflow passage having an upper end and a lower end and including a first valve member at the upper end of the water outflow passage, a float assembly that is movable relative to the valve base between a sealing position in which a second valve member at a lower end of the float assembly engages the first valve member in sealing relationship and a flushing position in which the second valve member is spaced upwardly from the first valve member, the float assembly being adjustable in buoyancy, an overflow tube that is attached to the float assembly and extends upward from a lower end in fluid communication with the water outflow passage of the valve base to an upper end in fluid communication with the interior space of the toilet tank, the upper end of the overflow tube being adjustable relative to the float assembly independently of buoyancy of the float assembly, a guide member that extends upward from the valve base for guiding movement of the float assembly relative to the valve base, the guide member defining a passageway extending longitudinally of the guide member from an inlet at an upper end region of the guide member, for connection to the water supply valve, to an outlet at a lower end region of the guide member in fluid communication with the water outflow passage of the valve base, and a stop member mounted on the guide member at a location above the float assembly for limiting upward travel of the float assembly from its sealing position, the stop member being adjustable in position through extension of the guide member independently of the buoyancy of the float assembly and independently of the upper end of the overflow tube.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figures 1, 2, 6:
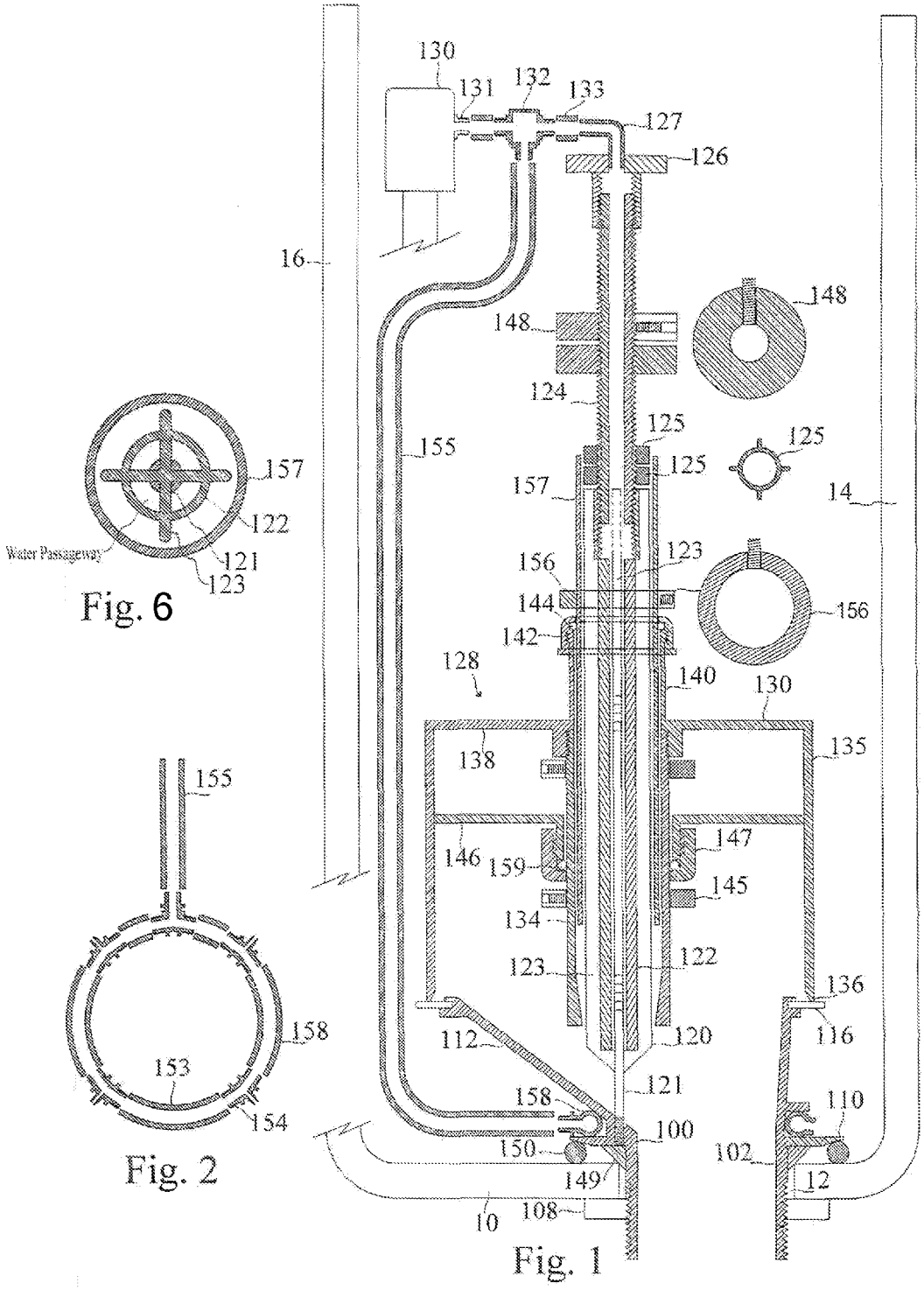
FIG. 1 is a sectional view of a toilet tank equipped with a first flush valve structure.
FIG. 2 is a schematic view of an agitation collar that is installed around the valve base of the flush valve structure shown in FIG. 1.
FIG. 6 is a sectional view of a guide member included in the first flush valve structure depicted in FIG. 1.

The toilet tank 2 shown in FIG. 1 is a conventional low-volume toilet tank having a floor 10 formed with a valve base installation hole, or outlet hole, 12 and also having front and rear walls 14, 16 and two side walls (not shown). The front and rear walls are typically about 17.8 cm (7 inches) apart whereas the side walls may be about 35.6 cm (14 inches) apart. As shown in FIG. 1, the hole may be substantially closer to the front wall 14 than the rear wall 16.

The flush valve structure that is shown in FIG. 1 is a single float valve structure, as opposed to a dual float valve structure as disclosed in US Patent Application Publication No. 2009-0013456, and comprises a valve base 100 that is installed in the hole 12 in the floor 10 of the toilet tank and is held in position by a nut 108 that is in threaded engagement with the base 100. The valve base 100 defines a water outflow opening 102 and includes a flange 110, and an extension 112 extends upward from the flange. The extension 112 may be integrally formed with the valve base 100, e.g. by concurrent injection molding of the base and the extension, or may be formed as a separate component that is attached to the valve base. The extension defines a passage that is circular in horizontal section at all points over its height, but the horizontal cross-sectional area of the passage is substantially greater at the top of the extension than at the bottom. For example, the diameter of the passage at the bottom of the extension may be less than 5.1 cm (2 inches), in order to match a valve base sized to fit in a standard two inch outlet hole, whereas the diameter of the passage at the top of the extension may be almost 12.7 cm (5 inches). Thus, as shown in FIG. 1, the extension 112 flares upward from the flange 110. Moreover, the extension has a skewed configuration, in that the locus of the center of the circular horizontal cross section of the passage is inclined to vertical, so that the center of the circular cross section of the passage at the top of the extension is located approximately midway between the front and rear walls of the tank even though the center of the outlet hole is closer to the front wall than the rear wall. A sealing member 116 is attached to the extension 112 at the top. In this case, the sealing member 116 is a flexible gasket.

A guide 120 extends vertically upward from the valve base. The lower end of the guide 120 is a relatively slender rod 121 that is in threaded engagement with the valve base at one side of the water outflow opening 102 defined by the valve base. Above its lower end, the guide has a tubular segment 122. Four ribs 123 projecting from the rod 121 and from the tubular segment in a cross-like configuration serve to connect the two segments.

The tubular segment 122 of the guide is internally threaded at its upper end and an externally threaded extension tube 124 is in threaded engagement with the tubular segment. Internally threaded lock collars 125 in threaded engagement with the extension tube are tightened against the upper end of the tubular segment and prevent inadvertent loosening of the threaded engagement of the extension tube and the tubular segment of the guide. By loosening the lock collars 125, the extension tube can be removed and replaced with a longer or shorter extension tube, if desired or necessary. At its upper end, the extension tube is provided with a removable retainer member 126 incorporating a hose coupling 127.

The toilet tank is provided with a float-controlled fill valve 130 having a primary outlet (not shown) that discharges water into the interior space of the tank when the fill valve is open and a secondary outlet 131 that is connected by a T-coupling 132 and a flexible hose 133 to the hose coupling 127 at the top of the extension tube 124. It will be appreciated that the hoses and hose couplings are shown only schematically in FIG. 1. The T-coupling 132 also connects the secondary outlet 131 of the fill valve to an agitation collar 158. The purpose of the agitation collar, which is also shown in FIG. 2, will be described in further detail below.

The flush valve structure shown in FIG. 1 also includes a float assembly 128. The float assembly comprises an outer shell 130 having a cylindrical outer wall 135 provided at its lower end with a sealing member 136 that cooperates with the sealing member 116 of the extension 112, a first or upper annular disc-wall 138 extending inward from the outer wall 135 at the upper end thereof, and an inner boss or sleeve 140 that extends upwardly from the first annular disc-wall 138. An overflow tube 157 extends with a small clearance through the inner boss 140.

The inner boss 140 is threaded at its upper end and a nut 142 having an internal flange is in threaded engagement with the threads of the inner boss. When the nut 142 is tightened onto the inner boss 140, an O-ring 144 is clamped between the internal flange of the lock nut and the upper end of the boss. By clamping the O-ring in this manner, the O-ring grips the overflow tube 157, thus holding the outer shell 130 in position relative to the overflow tube 157, and seals the clearance between the inner boss and the overflow tube 157. A locking collar 156 provided with a set screw prevents loosening of the nut 142.

An extension tube 134 that is coaxial with the inner boss is in threaded engagement with a short sleeve that extends downward from the first disc-wall 138. The overflow tube 157 extends within the extension tube 134 in telescoping fashion. At its lower end the extension tube 134 extends downward beyond the lower end of the overflow tube 157.

The guide 120 extends through the overflow tube 157 and the extension tube 134 with a clearance that is sufficient to permit movement of the tubes 157, 134, and the float assembly attached thereto, lengthwise of the guide without binding yet is small enough to ensure that the float assembly remains properly aligned relative to the sealing member 116. In this regard it will be noted that the interior of the extension tube below the overflow tube tapers in order to reduce clearance between the lower end of the extension tube and the ribs 123.

A second or lower annular disc-wall 146 is attached to the extension tube 134. As shown, a short, externally threaded sleeve extends downward from the lower annular disc-wall and a nut 147 having an internal flange is in threaded engagement with the threads of the sleeve. When the nut 147 is tightened onto the sleeve, an O-ring 159 is clamped between the internal flange of the lock nut and the lower end of the sleeve. By clamping the O-ring in this manner, the O-ring grips the extension tube 134, thus holding the lower annular disc-wall in position relative to the extension tube, and seals the clearance between the sleeve and the extension tube. By releasing the nut 147, the lower disc-wall can be adjusted in position relative to the upper disc-wall 138 and the cylindrical outer wall 135. A locking collar 145 provided with a setscrew is positioned tightly against the nut 47 prevents loosening of the nut 147 and thereby prevents movement of the lower disc-wall 146 relative to the extension tube 134.

The outer shell 130, the extension tube 134 and the second annular disc-wall 146 together define a float chamber. By releasing the lock nut 147, moving the lower disc-wall 146 lengthwise of the extension tube 134, and re-tightening the locknut, the position of the lower disc-wall 146 relative to the first annular disc-wall 138, and hence the volume of the float chamber, is adjustable. FIG. 1 shows the float assembly with the second annular disc-wall 146 positioned to provide a small volume and a small resultant buoyancy of the float chamber, whereas by adjusting the position of the second disc-wall it is possible to provide a float chamber of substantially greater volume and resultant greater buoyancy. By releasing the lock nut 142 and moving the shell 130 lengthwise of the overflow tube 157, and re-tightening the locknut, the position of the shell 130 and the lower disc-wall 146 relative to the overflow tube is adjustable.

Because the O-ring 144 not only grips the overflow tube but also seals the float chamber at the upper end, air cannot be displaced from the float chamber by water entering the chamber through the clearance between the lower annular disc-wall 146 and the cylindrical outer wall 135. Otherwise, water entering the float chamber through the clearance could lead eventually to the float chamber becoming waterlogged.

Above the locking collars 125 the threaded extension tube 124 is provided with a stop member 148. The stop member may comprise a pair of internally threaded collars and/or an internally threaded collar provided with a set screw. It will be understood by those skilled in the art that by tightening the threaded collars against each other and/or by tightening the set screw, the stop member 148 can be secured against movement longitudinally of the extension tube 124; and by loosening the threaded collars and set screw the stop member 148 can be released, allowing movement of the stop member longitudinally of the extension tube 124.

The float assembly 128 is provided with an attachment ring (not shown) that can be connected to a flush lever or rod (not shown) for lifting the float assembly from the seal. The flush lever is connected to a flush actuator located outside the toilet tank. When the flush actuator is operated, and the lever is lifted sufficiently to lift the float assembly, the seal between the sealing members 116 and 136 is broken. The buoyancy of the float assembly overcomes the force due to the pressure of water on the top of the upper annular disc-wall and any downward force acting on the float assembly due to flow of water into the passage defined by the extension. Accordingly, even though the user may immediately release pressure on the flush lever, the float assembly immediately rises until the upper end of the overflow tube 157 engages the stop member 148. When the upper end of the overflow tube engages the stop member, the float assembly initially remains in this position as the water level in the toilet tank falls due to outflow of water through the valve base, When the level of water in the tank has fallen sufficiently for the fill valve 130 to open, water commences to flow into the tank. Nevertheless, the water level in the tank continues to fall until the float assembly is close enough to the sealing member 116 for the force acting on the float assembly due to flow of water into the outflow passage to overcome the buoyancy of the float assembly and pull the sealing member 136 into contact with the sealing member 116. The water level in the tank then rises, as is conventional, until the fill valve shuts off supply of water.

While the fill valve is open, water flows through the flexible hose 127, the extension tube 124 and the tubular guide 122 into the valve base and fills the toilet bowl, sealing the trap at the outlet of the toilet bowl.

When the toilet bowl contains only liquid waste, the user activates the flush valve by pressing the flush actuator and then immediately releases the flush actuator. Depending on the adjustment position of the second annular disc-wall 146 (as discussed below), the quantity of water that is discharged from the tank in response to a press and immediate release activation of the flush lever is sufficient to remove liquid waste and most solid waste from the toilet bowl. In the event that the user observes that solid waste remains in the bowl after pressing the flush lever, the user may maintain pressure on the flush actuator, in which event the float assembly will remain elevated relative to the seal member at the upper rim of the extension and residual tank and fill valve supply water will continue to flow through the valve body and into the toilet bowl. The user releases the flush actuator upon observing that the waste has been removed from the toilet bowl.

The quantity of water discharged from the toilet tank in response to a press and immediate release activation of the flush lever depends on the extent of the upward travel of the float assembly from the lower position, in which the sealing member 136 in contact with the sealing member 116, to the upper position, in which further upward movement is limited by the stop member 148. The greater the distance, the longer is the time between breaking of the seal and restoration of the seal, and the greater is the quantity of water discharged. In the case of FIG. 1, the extent of the upward travel of the float assembly 128 is equal to the distance between the top of the overflow tube 157 and the stop member 148 when the float assembly is in its lower position.

Different models of toilet assemblies (toilet bowl and toilet tank) have different flushing characteristics. The different flushing characteristics of different models of toilet assemblies result in a greater or lesser quantity of water being needed to both remove liquid waste from the toilet bowl and fill the toilet bowl and restore the trap after a flush. It has been found that by adjusting the upward travel of the float assembly, by adjusting the position of the overflow tube 157 relative to the float assembly, it is possible to adjust the quantity of water that is discharged from the toilet tank in response to a press and immediate release activation of the flush lever. Adjustability of the overflow tube 157 relative to the outer shell 130 allows a given model of flush valve structure to be used with multiple models of toilet assemblies, each of which may require its own unique combination of flush volumes for satisfactory liquid and solid waste removal. This is useful because it allows a single model of flush valve structure to be used as a replacement part in multiple models of toilet assemblies.

Still referring to FIG. 1, when the valve base 100 is installed in the outlet hole 12 and the nut 108 is tightened, a sealing member 149 is clamped between the valve base and the periphery of the outlet hole 12 to provide a seal preventing escape of water from the tank. A significant cause of water leakage in a conventional toilet tank installation is due to deterioration of the sealing member 149 through constant contact with the water in the tank. In order to limit or prevent deterioration of the sealing member 149, an O-ring 150 is positioned under tension between lip of the flange 110 and the floor 10 of the toilet tank. The O-ring 150 is installed when the tank is empty and the floor of the tank is dry, and accordingly the O-ring isolates the sealing member 149 from the water in the tank. The diameter of the flange 110 is larger than might otherwise be necessary in order to permit use of an O-ring that is large enough fit over the upper end of the flared extension 112.

The flush valve structure shown in FIG. 1 is suitable for retrofit in an existing toilet tank installation. By adjusting the position of the disc-wall 146, the buoyancy of the float is adjustable, and the upward travel of the float is adjustable both by adjusting the position of the stop member 148 along the extension tube 124 and by adjusting the position of the overflow tube 157 relative to the float. These adjustments allow the toilet tank flush valve structure to be adapted to a wide range of installations and achieve desired flush water volume suitable for the particular installation.

Figure 3:
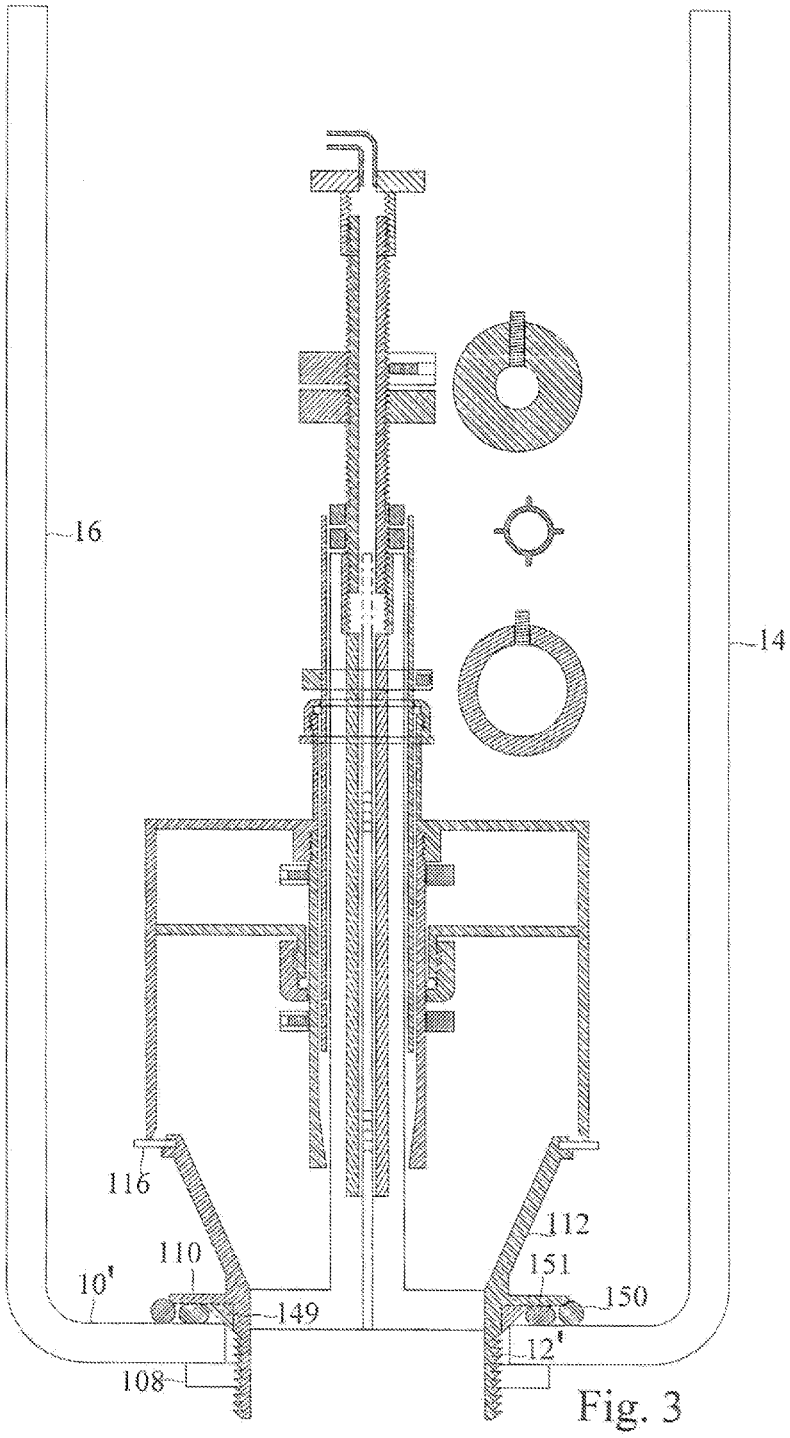
FIG. 3 is a sectional view of a toilet tank equipped with a second flush valve structure.

In the case of the flush valve structure shown in FIG. 1, the central axis of the float assembly is offset horizontally from the central axis of the flange of the valve base by virtue of the skewed configuration of the flared extension 112. FIG. 3 illustrates a modification of the flush valve structure shown in FIG. 1. The outlet hole 12 of the toilet tank is centered between the front and rear walls 14, 16 of the toilet tank and accordingly the extension 112' is not skewed. Thus, the circular openings at the top and bottom respectively of the extension 112' are coaxial. In addition, the outlet hole 12 is of greater diameter than the outlet hole in the case of FIG. 1. For example, in the case of FIG. 3 the outlet hole may be as much as 8.9 cm (3.5 inches) in diameter.

The flange 110' of the valve base shown in FIG. 3 is enlarged relative to the flange of the valve base shown in FIG. 1. Because the flange 110' is of approximately the same diameter as the upper end of the extension 112', the O-ring 150 need only be stretched slightly to fit over the upper end of the extension. Consequently, in the event of deterioration, or expected deterioration, of the O-ring 150, the O-ring can be removed and replaced without removing the valve base from the floor of the toilet tank. A second O-ring 151 is clamped between the flange 110' and the floor of the toilet tank at a location inward of the O-ring 150. The second O-ring is made of particularly soft and compliant, but nevertheless resilient, material and forms a seal between the flange and the floor of the toilet tank. The O-ring 151 is installed at the time of installation of the valve base and cannot be removed without removing the valve base whereas the O-ring 150 may be removed and replaced periodically without removing the valve base. The O-ring 151 provides primary isolation between the sealing member 149 and the water in the toilet tank and the O-ring 150 provides a second level of isolation.

As shown in FIG. 3, the sealing member 116 is well above the floor 10 of the toilet tank. Consequently, the water close to the floor 10 is not disturbed substantially during a flushing operation and sediment may accumulate below the sealing member 116 and settle on the floor of the tank. The agitation collar 158 shown in FIGS. 1 and 2 is provided in order to mitigate this problem. The agitation collar comprises several segments of hose 153 and push-on connecting fittings 154 forming a ring that is positioned around the valve base. As shown, the agitation collar is located immediately above the flange 110 but it may alternatively be placed on the floor of the toilet tank. In either event, the agitation collar is reliably held in position in the toilet tank. One of the fittings is a T-coupling that is connected to the T-coupling 132 by a length of hose. Other fittings have nozzle outlets. When the fill valve 130 opens, water is supplied to the agitation collar from the secondary outlet 131 of the fill valve and the nozzles create jets of water that disturb sediment in the bottom of the toilet tank. Therefore, each time the toilet bowl is flushed, a portion of any sediment in the toilet tank is removed from the toilet tank with the water that is discharged into the toilet bowl. Because the agitation collar is positioned around the valve base, the agitation collar has little freedom to move around in the toilet tank and potentially interfere with operation of the flush valve or the fill valve. The valve structure shown in FIG. 3 may be provided with an agitation collar (not shown).

Figure 4:
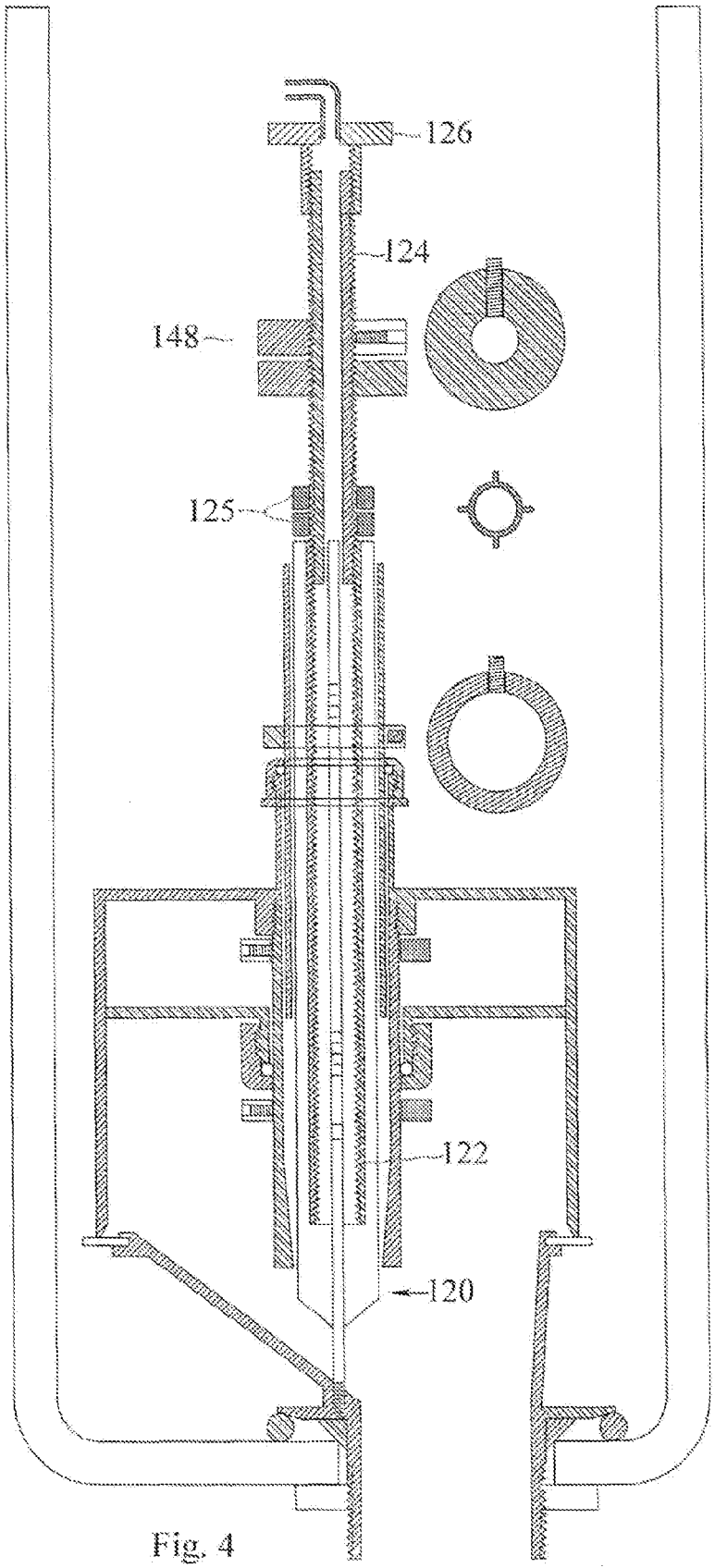
FIG. 4 is a sectional view of a toilet tank equipped with a third flush valve structure.

FIG. 4 illustrates a flush valve structure that is similar in many ways to the flush valve structure shown in FIG. 1. However, in the case of FIG. 4 the tubular segment 122 of the guide 120 is internally threaded over a length that is greater than that of the extension tube 124. Accordingly, the extent to which the extension tube projects above the upper end of the tubular segment 122 can be adjusted over a wide range and when the extension tube has been adjusted to provide a desired extent of projection the extension tube can be secured in position by the lock collars 125. It will be appreciated that by selecting an extension tube of a particular length a wide range of projection extents can be provided. Further, in this case the stop member 148 can be omitted and the retaining member 126 may then be used to limit upward movement of the overflow tube (and the float assembly attached thereto).

Figure 5:
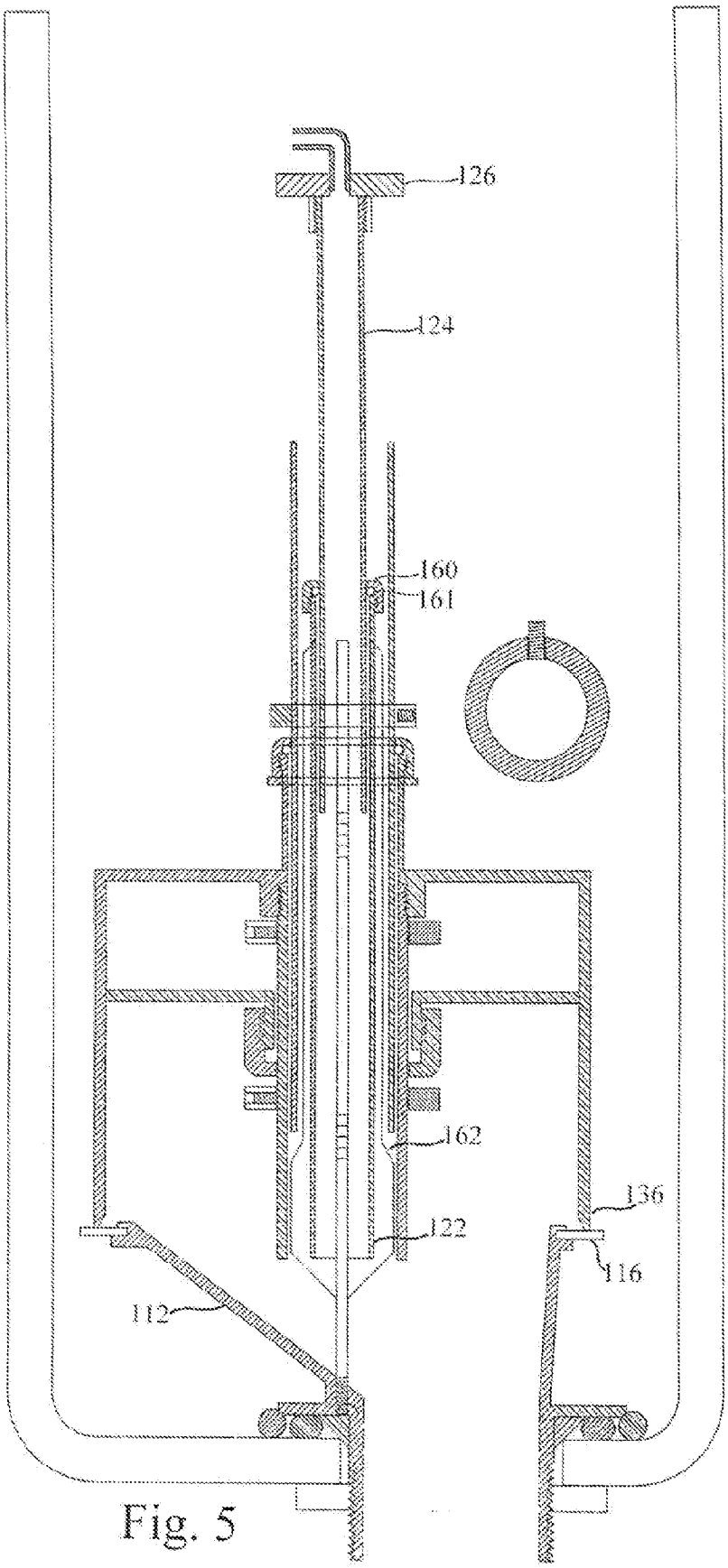
FIG. 5 is a sectional view of a toilet tank equipped with a fourth flush valve structure.

FIG. 5 illustrates a flush valve structure that is similar in many ways to the flush valve structure shown in FIG. 4. However, in the case of FIG. 5 the tubular segment 122 of the guide 120 is slidably extendable over a length that is as great as that of the extension tube 124. Accordingly, the extent to which the extension tube projects above the upper end of the tubular segment 122 can be adjusted over a wide range and when the extension tube has been adjusted to provide a desired extent of projection the extension tube can be secured in position by the lock nut 160 and a compression member such as the O-ring 161. A lower portion 162 of the guide 120 is flared radially to ensure alignment of the sealing member 136 with the sealing member 116 of the extension 112. It will be appreciated that by selecting an extension tube of a particular length a wide range of projection extents can be provided. Further, in this case the stop member 148 can be omitted and the retaining member 126 may then be used to limit upward movement of the overflow tube (and the float assembly attached thereto).

The drawings illustrate self-contained flush valve structures having three independent adjustments that do not require modification (e.g. cutting) of any of the basic component parts of the flush valve structure. The three independent adjustments (buoyancy of the float assembly, upward travel of the float assembly, and height of the upper end of the overflow tube) allow the valve structure to be installed in virtually any toilet installation and adjusted to provide a desired flush volume. If desired, the various adjustment mechanisms may then be secured to prevent further adjustment and/or prevent deliberate or inadvertent further adjustment by application of suitable cement.

In general, it will be desirable that the installer should first position the stop member 148 somewhat below the hole in the wall of the toilet tank through which the flush actuator is connected to the flush lever, so that the top of the overflow tube will remain below the hole and prevent overflow of the tank. Then, the installer will adjust the position of the lower disc-wall 146 to achieve a low volume flush. Finally, the installer adjusts the position of the overflow tube relative to the float assembly 128 in order to achieve a particular minimum flush water volume needed for high efficiency toilet (as defined by the United States Environmental Protection Agency). It will be appreciated that the greater the head of water in the toilet tank, the greater the outflow pressure from the toilet tank and the greater the velocity of flow of water into the toilet bowl. The head of water in the toilet tank depends on the fill valve, but during filling of the tank the fill valve must close before the level of water reaches the upper end of the overflow tube. Thus, in order to maximize the head of water available for flushing, the upper end of the overflow tube should be as high as possible, but in no case higher than about 1.3 cm (one half inch) below the flush valve actuator attachment opening in the toilet tank wall.

It will be appreciated that the invention is not restricted to the particular embodiment or embodiments that has or have been described, and that variations may be made therein without departing from the scope of the invention as defined in the appended claims, as interpreted in accordance with principles of prevailing law, including the doctrine of equivalents or any other principle that enlarges the enforceable scope of the claims beyond the literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

The invention claimed is:

1. A toilet tank flush valve structure, for use with a toilet tank that is provided with a water supply valve and has an interior space bounded by a floor formed with an outlet hole, the flush valve structure comprising:

a valve base for installation in the outlet hole formed in the floor of the toilet tank, the valve base defining a water outflow passageway having an upper end and a lower end and including a first valve member at the upper end of the water outflow passage, a float assembly that is movable relative to the valve base between a sealing position in which a second valve member at a lower end of the float assembly engages the first valve member in sealing relationship and a flushing position in which the second valve member is spaced upwardly from the first valve member, the float assembly having an adjustable buoyancy configured to overcome the head pressure of water above it and float upwards once a flush has been initiated and defining a passageway extending upwardly therethrough, wherein the float assembly comprises:

an outer shell that:

is open downwards to define an opening, includes an upper annular wall opposite the opening, and has a lower edge at which the shell is provided with said second valve member, a closure member within the outer shell and cooperating with the outer shell to define a float chamber, and an adjustment mechanism disposed within the outer shell and configured to selectively adjust the position of the closure member relative to the upper annular wall to selectively adjust the volume of the float chamber, an overflow tube extending upward through the passageway defined by the float assembly, wherein the overflow tube extends upward from a lower end in fluid communication with the water outflow passageway of the valve base to an upper end in fluid communication with the interior space of the toilet tank and is adjustable in position relative to the float assembly independently of adjustment of the closure member relative to the outer shell, and a guide member that extends upward from the valve base through the overflow tube for guiding movement of the float assembly relative to the valve base, and wherein the guide member includes a stop element at a location above the float assembly for limiting upward travel of the float assembly from its sealing position, and the stop element is adjustably positioned relative to the valve base whereby a distance of said upward travel is selectively adjustable, and wherein the guide member defines a fluid passageway delivering water originating from the water supply valve to the valve base;

wherein the guide member comprises:

a lower tubular core segment with outwardly projecting ribs; and an upper tubular core segment engaged with the lower tubular core segment and extends upwards.

2. A flush valve structure according to claim 1, wherein the upper annular wall comprises a downward extension tube and the overflow tube extends within said downward extension tube.

3. A flush valve structure according to claim 2, wherein the extension tube has an upper portion of internal diameter slightly greater than the external diameter of the overflow tube, to provide a snug sliding fit of the overflow tube within said upper portion of the extension tube, and a lower portion of reduced internal diameter relative to the upper portion for cooperating with the guide member for guiding movement of the float assembly.

4. A flush valve structure according to claim 1, wherein the valve base includes a flange for positioning within the tank above the floor of the toilet tank, a water outflow tube that extends downward from the flange to enter the outlet hole formed in the floor of the toilet tank, and an extension that flares upwardly from the flange, and the first valve member is attached at an upper end of the extension in a position where it may be replaced without removing the valve base from the toilet tank.

5. A flush valve structure according to claim 1, wherein the valve base has an internally threaded hole at one side of the water outflow passageway and the lower tubular core segment with outwardly projecting ribs of the guide member is externally threaded at its lower end and is in threaded engagement with the valve base.

6. A flush valve structure according to claim 1, wherein:

the lower tubular core segment is internally threaded proximate the upper end of the overflow tube the upper tubular core segment is externally threaded and releasably engaged with the internal threads of the lower tubular core segment, and the stop element is threadingly attached to the externally threaded upper tubular core segment;

wherein adjusting the threaded engagement of the upper tubular core segment within the lower tubular core segment thereby adjusts the vertical position of the stop element.

7. A flush valve structure according to claim 6, wherein the stop member includes internal threads and the internal threads of the stop member adjustably engage the external threads of the upper tubular core segment of the guide member to adjust the position of the stop member lengthwise the upper tubular core segment of the guide member independently of the buoyancy of the float assembly and independently of the upper end of the overflow tube.

8. A flush valve structure according to claim 1, wherein the float chamber is adjustable in volume by moving the closure member relative to the upper annular wall inside the outer shell independently of adjustment of the overflow tube and said stop element.

9. A toilet tank installation comprising:

a toilet tank having an interior space bounded by a floor formed with an outlet hole, a water supply valve positioned inside the tank and connected to a water source, and a flush valve structure comprising a valve base installed in the outlet hole formed in the floor of the toilet tank, the valve base defining a water outflow passageway having an upper end and a lower end and including a first valve member at the upper end of the water outflow passage; a float assembly that is vertically movable relative to the valve base between a sealing position in which a second valve member at a lower end of the float assembly engages the first valve member in sealing relationship and a flushing position in which the second valve member is spaced upwardly from the first valve member, the float assembly defining a passageway extending upwardly therethrough, wherein the float assembly comprises:

an outer shell that:

is open downwards to define an opening, includes an upper annular wall opposite the opening, has a lower edge at which the shell is provided with said second valve member, and a closure member within the outer shell and cooperating with the outer shell to define a float chamber, and an adjustment mechanism disposed within the outer shell and configured to selectively adjust the position of the closure member relative to the upper annular wall to selectively adjust the volume of the float chamber; and an overflow tube extending upward through the passageway defined by the float assembly, wherein the overflow tube extends upward from a lower end in fluid communication with the water outflow passageway of the valve base to an upper end in fluid communication with the interior space of the toilet tank and is adjustable in position relative to the float assembly independently of adjustment of the closure member relative to the outer shell; and a guide member that extends upward from the valve base through the overflow tube for guiding movement of the float assembly relative to the valve base; and wherein the guide member includes a stop element at a location above the float assembly for limiting upward travel of the float assembly from its sealing position, and the stop element is adjustably positioned relative to the valve base whereby a distance of said upward travel is selectively adjustable; and wherein the guide member defines a fluid passageway delivering water originating from the water supply valve to the valve base;

wherein the guide member comprises:

a lower tubular core segment with outwardly projecting ribs; and an upper tubular core segment engaged with the lower tubular core segment and extends upwards.

10. A toilet tank flush valve structure, for use with a toilet tank that is provided with a water supply valve and has an interior space bounded by a floor formed with an outlet hole, the flush valve structure comprising:

a valve base for installation in the outlet hole formed in the floor of the toilet tank, the valve base defining a water outflow passageway having an upper end and a lower end and including a first valve member at the upper end of the water outflow passage, a float assembly that is movable relative to the valve base between a sealing position in which a second valve member at a lower end of the float assembly engages the first valve member in sealing relationship and a flushing position in which the second valve member is spaced upwardly from the first valve member, the float assembly defining a passageway extending upwardly therethrough and comprising:

an outer shell that:

is open downwards to define an opening, includes an upper annular wall opposite the opening, and has a lower edge at which the shell is provided with said second valve member, a closure member within the outer shell and cooperating with the outer shell to define a float chamber, and an adjustment mechanism disposed within the outer shell and configured to selectively adjust the position of the closure member relative to the upper annular wall to selectively adjust the volume of the float chamber, an overflow tube extending upward through the passageway defined by the float assembly, wherein the overflow tube is adjustably attached to the float assembly and extends upward from a lower end in fluid communication with the water outflow passageway of the valve base to an upper end in fluid communication with the interior space of the toilet tank, and a guide member that extends upward from the valve base through the overflow tube for guiding movement of the float assembly relative to the valve base, the guide member comprising a lower portion that extends upward from the valve base through the overflow tube, an upper portion that is releasably attached to the lower portion at an upper end thereof and extends upward from the upper end of the lower portion, and a stop element mounted on the upper portion at a location above the float assembly for limiting upward travel of the float assembly from its sealing position, the stop element being adjustably positioned relative to the valve base whereby a distance of said upward travel is selectively adjustable.

11. A toilet tank flush valve structure according to claim 10, wherein the lower portion of the guide member comprises a tubular core and ribs projecting outward from the core and the upper portion is tubular, whereby the guide defines an internal passageway extending longitudinally of the guide member from an inlet at an upper end region of the guide member, for connection to the water supply valve, to an outlet at a lower end region of the guide member in fluid communication with the water outflow passageway of the valve base.

12. A flush valve structure according to claim 10, wherein the upper annular wall comprises a downward extension tube and the overflow tube extends within said downward extension tube.

13. A flush valve structure according to claim 12, wherein the extension tube has an upper portion of internal diameter slightly greater than the external diameter of the overflow tube, to provide a snug sliding fit of the overflow tube within said upper portion of the extension tube, and a lower portion of reduced internal diameter relative to the upper portion for cooperating with the guide member for guiding movement of the float assembly.

14. A flush valve structure according to claim 10, wherein the valve base includes a flange for positioning within the tank above the floor of the toilet tank, a water outflow tube that extends downward from the flange to enter the outlet hole formed in the floor of the toilet tank, and an extension that flares upward from the flange, and the first valve member is attached at an upper end of the extension in a position where it may be replaced inside the tank without removing the valve base.

15. A flush valve structure according to claim 14, wherein the extension is horizontally skewed, whereby the upper end of the extension is horizontally offset from a lower end thereof.

16. A flush valve structure according to claim 15, wherein the valve base has an internally threaded hole at one side of the water outflow passageway within the valve base sidewall and within the interior of the valve base and the guide member is externally threaded at its lower end and is in threaded engagement with the valve base.

17. A flush valve structure according to claim 15, wherein the guide member has a lower end at which it is threadedly attached to the valve base.

18. A flush valve structure according to claim 10, wherein the guide member comprises a lower portion located at least partially below an upper end of the overflow tube and comprises internal threads at the upper end of the overflow tube, and an upper portion having external threads releasably attached to the lower portion at an upper end thereof and extends upward from the lower portion, and the stop element is attached to the upper portion at a location above the float assembly.

19. A flush valve structure according to claim 18, wherein the upper portion of the guide member is adjustable in position lengthwise relative to the lower portion of the guide member.

20. A flush valve structure according to claim 18, wherein the stop member is internally threaded and is adjustable in position lengthwise of the guide member independently of the buoyancy of the float assembly and independently of the upper end of the overflow tube.

21. A flush valve structure according to claim 10, wherein the closure member is adjustable in position relative to the upper annular wall within the outer shell to adjust the volume of the float chamber independently of adjustment of the overflow tube and said stop element.

22. A toilet tank installation comprising:

a toilet tank having an interior space bounded by a floor formed with an outlet hole, a water supply valve positioned inside the tank and connected to a water source, and a flush valve structure comprising a valve base for installation in the outlet hole formed in the floor of the toilet tank, the valve base defining a water outflow passageway having an upper end and a lower end and including a first valve member at the upper end of the water outflow passage; a float assembly that is movable relative to the valve base between a sealing position in which a second valve member at a lower end of the float assembly engages the first valve member in sealing relationship and a flushing position in which the second valve member is spaced upwardly from the first valve member, the float assembly comprising:

an outer shell that:

is open downwards to define an opening, includes an upper annular wall opposite the opening, and has a lower edge at which the shell is provided with said second valve member, defines a passageway extending upwardly therethrough;

a closure member within the outer shell and cooperating with the outer shell to define a float chamber, and an adjustment mechanism disposed within the outer shell and configured to selectively adjust the position of the closure member relative to the upper annular wall to selectively adjust the volume of the float chamber, an overflow tube extending upward through the passageway defined by the float assembly, wherein the overflow tube is adjustably attached to the float assembly and extends upward from a lower end in fluid communication with the water outflow passageway of the valve base to an upper end in fluid communication with the interior space of the toilet tank; and a guide member that extends upward from the valve base through the overflow tube for guiding movement of the float assembly relative to the valve base, the guide member comprising a lower tubular core segment with outwardly extending ribs that extends upward from the valve base through the overflow tube, an upper engaged tubular core segment that is releasably attached to the lower tubular core segment at an upper end thereof and extends upward from the upper end of the lower portion, and a stop element mounted on the upper portion at a location above the float assembly for limiting upward travel of the float assembly from its sealing position, the stop element being adjustably positioned relative to the valve base whereby extension of the stop element is selectively adjustable.

23. A toilet tank installation according to claim 22, wherein the guide defines an internal passageway extending longitudinally of the guide member from an inlet at an upper end region of the guide member, connected to the water supply valve, to an outlet at a lower end region of the guide member in fluid communication with the water outflow passageway of the valve base.

24. A combination of flush valve components for use with a toilet tank having interior space, a water supply valve, a floor, and a valve base, the floor defining an outlet hole, the valve base extending from the outlet hole to define a water outflow passageway having an upper end and a lower end and including a flange for positioning the valve base within the outlet hole, the combination of flush valve components comprising:

a first valve member component configured to removably attach to the upper end of the valve base;

a float valve assembly component having an adjustable buoyancy configured to overcome the head pressure of water above it and float upwards once a flush has been initiated and defining a passageway extending upwardly therethrough, the float valve assembly component comprising:

an outer shell that:

is open downwards to define an opening, includes an upper annular wall opposite the opening, and has a lower end;

a closure member within the outer shell and cooperating with the outer shell to define a float chamber; and an adjustment mechanism disposed within the outer shell and configured to selectively adjust the position of the closure member relative to the upper annular wall to selectively adjust the volume of the float chamber, a second valve member component at the lower end of the float valve assembly component;

an overflow tube component extending upward through the passageway defined by the float valve assembly component, wherein the overflow tube component extends upward from a lower end in fluid communication with the water outflow passage of the valve base to an upper end in fluid communication with the interior space of the toilet tank and is adjustable in position relative to the float valve assembly component independently of adjustment of the closure member relative to the outer shell, and a guide member component that extends upward from the valve base through the overflow tube for guiding movement of the float valve assembly component relative to the valve base, and wherein the guide member component includes a stop element at a location above the float valve assembly component for limiting upward travel of the float valve assembly component from its sealing position, and the stop element is adjustably positioned relative to the valve base whereby a distance of said upward travel is selectively adjustable, and wherein the guide member component defines a fluid passageway extending from above the float assembly to the valve base;

wherein the float valve assembly component is movable relative to the first valve member between a sealing position in which the second valve engages the first valve member component in sealing relationship and a flushing position in which the second valve member component is spaced upwardly from the first valve member component;

wherein the guide member component defines a fluid passageway delivering water originating from the water supply valve to the valve base;

wherein the guide member component comprises:

a lower tubular core segment with outwardly projecting ribs; and an upper tubular core segment engaged with the lower tubular core segment and extends upwards.

25. A flush valve structure according to claim 1, wherein the valve base includes a flange for positioning within the tank above the floor of the toilet tank, a water outflow tube that extends downward from the flange to enter the outlet hole formed in the floor of the toilet tank, and an extension that extends and is skewed upwardly from the flange, and the first valve member is attached at an upper end of the extension.

26. A flush valve structure according to claim 1, wherein:

the lower tubular core segment is internally threaded proximate the upper end of the overflow tube;

the upper tubular core segment is externally threaded and releasably engaged with the internal threads of the lower tubular core segment at an upper end of the lower tubular core segment; and the stop element is threadingly attached to a medial portion of the externally threaded upper tubular core segment;

wherein the stop element is threadingly adjustable lengthwise relative to the upper tubular core segment.

27. A flush valve structure according to claim 1, wherein:

the upper tubular core segment is slidably adjustable with the lower tubular core segment with outwardly projecting ribs and is externally threaded at its upper end; and the stop element is threadingly attached to said upper end of the upper tubular core segment;

wherein sliding adjustment of the upper tubular core segment relative to the lower tubular core segment thereby adjusts the vertical position of the stop element, and further comprising a releasable lock mechanism selectively locking the position of the upper tubular core segment relative to the lower tubular core segment.

28. The flush valve structure of according to claim 6, further comprising a releasable lock mechanism selectively locking the position of the upper tubular core segment relative to the lower tubular core segment.

29. The flush valve structure of according to claim 26, further comprising a releasable lock mechanism selectively locking the position of the upper tubular core segment relative to the lower tubular core segment.

30. The flush valve structure according to claim 26, wherein the stop element defines a first stop element and further comprising an internally threaded stop element threadingly engaged with the upper tubular core segment in a position tightly abutting the first stop element.

31. The flush valve structure according to claim 4, further comprising:

a first valve member water agitator defining a collar fitted about the valve base wherein standard push-on T-fitting water jets secured within the collar may be adjustably rotated upwards and inwards towards the first valve member;

a toilet tank float controlled fill valve configured to discharge water into the toilet tank when open;

a secondary outlet that is connected by a T-coupling and flexible hose coupling at the top of the upper tubular core segment of the guide member;

wherein the T-coupling further couples the secondary outlet of the toilet tank float controlled fill valve to the first valve water agitator defining the collar.

32. The flush valve structure according to claim 31, wherein the first valve member water agitator is disposed between the flange and the first valve member.

33. The flush valve structure according to claim 1, wherein the valve base includes a flange having a lip, the flange extending within the toilet tank outward of the outlet hole in the floor of the toilet tank, and further comprising a sealing member under tension when in use and positioned between the lip of the flange and the floor.

34. The flush valve structure according to claim 33, wherein the sealing member is accessible at an outer periphery of the flange, whereby the sealing member is replaceable without removing the valve base from the floor of the toilet tank.

35. The flush valve structure according to claim 15, wherein the flange has a lip and further comprising a sealing member positioned between the lip and the floor, the sealing member being under tension when in use.

36. The flush valve structure according to claim 35, wherein the sealing member is accessible at an outer periphery of the flange, whereby the sealing member is replaceable without removing the valve base from the floor of the toilet tank.

37. The toilet tank flush valve structure according to claim 10, wherein the closure member is selectively positioned and fixed at a particular position relative to the upper inner annular wall to selectively establish and fix the volume of the float chamber.

* * * * *